US005397873A

United States Patent [19]

Stoops et al.

[11] Patent Number: 5,397,873

[45] Date of Patent: Mar. 14, 1995

[54] ELECTRIC HOT PLATE WITH DIRECT CONTACT P.T.C. SENSOR

[75] Inventors: John C. Stoops, Columbus, Miss.; Randall Markum, Vernon, Ala.; William W. Holmes, Columbus, Miss.

[73] Assignee: Emerson Electric Co., St. Louis, Mo.

[21] Appl. No.: 110,696

[22] Filed: Aug. 23, 1993

[51] Int. Cl.[6] ..... H05B 3/74

[52] U.S. Cl. ..... 219/450; 219/449; 219/458; 219/464

[58] Field of Search ..... 219/443–468

[56] References Cited

U.S. PATENT DOCUMENTS

| | | | |
|---|---|---|---|
| 3,710,076 | 1/1973 | Frazier | 219/449 |
| 3,953,711 | 4/1976 | Eck et al. | 219/464 |
| 4,243,874 | 1/1981 | Fischer | 219/449 |
| 4,286,377 | 9/1981 | Hurko et al. | 29/611 |
| 4,394,564 | 7/1983 | Dills | 219/449 |
| 4,611,112 | 9/1986 | Schreder | 219/464 |
| 4,645,911 | 2/1987 | Husslein | 219/464 |
| 4,740,664 | 4/1988 | Payne et al. | 219/449 |
| 4,960,978 | 10/1990 | Lorenz et al. | 219/465 |
| 5,113,170 | 12/1992 | Goessler et al. | 219/449 |
| 5,223,697 | 6/1993 | Wilde et al. | 219/464 |
| 5,227,610 | 7/1993 | Schultheis et al. | 219/449 |

FOREIGN PATENT DOCUMENTS

| | | | |
|---|---|---|---|
| 3327622 | 2/1985 | Germany | 219/452 |
| 3703768 | 8/1988 | Germany | 219/451 |
| 2225920 | 6/1990 | United Kingdom | 219/449 |

*Primary Examiner*—Bruce A. Reynolds
*Assistant Examiner*—John A. Jeffery
*Attorney, Agent, or Firm*—Polster, Lieder, Woodruff & Lucchesi

[57] ABSTRACT

Electrical heating apparatus (10) is used in an electric stove (R) having a glass/ceramic cooking surface (S). A pan (12) is mounted adjacent an underside of the cooking surface. An electrical heating element (20) installed in the pan heats a defined area (A) of the cooking surface when electrical current is applied to the element. A sensor (34) installed in direct contact with the cooking surface senses the temperature of the cooking area. A control unit (42), to which an output of the sensor is supplied, is responsive to the output to control current flow to the heating element. This allows the apparatus to respond to temperature changes at the cooking area to insure food is properly cooked.

6 Claims, 4 Drawing Sheets

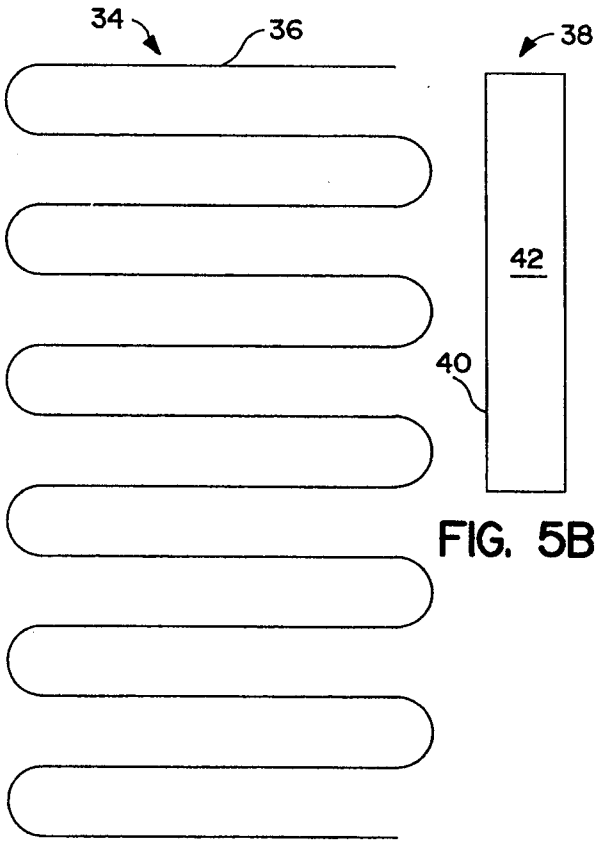
FIG. 5B
FIG. 5A
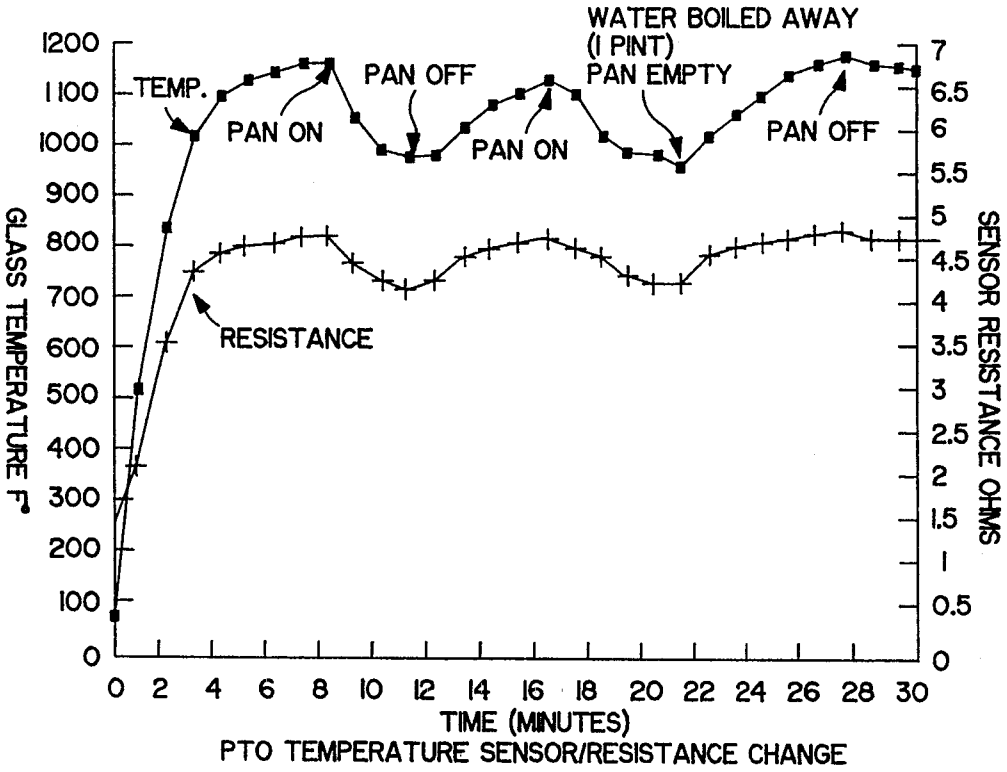
FIG. 6
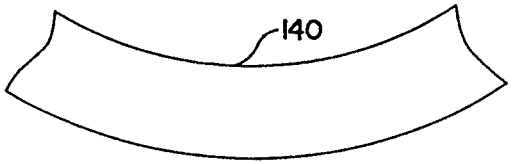
FIG. 5C

ELECTRIC HOT PLATE WITH DIRECT CONTACT P.T.C. SENSOR

BACKGROUND OF THE INVENTION

This invention relates to heating units for use in stoves or the like having glass/ceramic cooking tops and, more particularly, to a sensor unit for use in such units to improve their operation.

In cooking various foods, liquid or solid, it is often desirable to preset a cooking temperature at which the foods are to cook. Also, it is often suggested that the foods be cooked at this temperature for a particular length of time. A recipe, for example, may require that a liquid be brought to a boil and left boiling until the liquid is reduced to a stock used to complete the dish. Most stoves have cook tops with heating units whose temperature is controlled by a knob or similar temperature setting control. The temperatures set by turning the control are generally imprecise so that setting the control to a particular position means only that the heating unit temperature is within a range of temperatures approximating the desired temperature. As a rule, therefore, the cook will not necessarily know if, or when, the heating unit is at a required cooking temperature.

A second concern with controls described above involves knowing when to remove the pot, pan, or cooking dish from the stove. In the above example, if the pan with the liquid is left to heat after the liquid is boiled off, the stock may be ruined. It is common for cooks to be doing a number of things while preparing a dish so their attention is not focused on the cooking. Since even a short overcooking time can be disastrous, it would be beneficial to terminate the cooking immediately upon completion of the desired interval. Therefore, even if the cook is distracted and cannot personally remove the cooking utensil from the heating unit, the dish is not overheated and spoiled.

SUMMARY OF THE INVENTION

Among the several objects of the present invention may be noted the provision of an improved heating unit for use in stoves and the like; the provision of such an improved heating unit having a sensor for sensing when a cooking surface temperature is at a desired temperature, the heating unit heating the surface; the provision of such an improved heating unit employing a positive temperature coefficient (P.T.C.) sensing element to provide temperature sensing; the provision of such an improved heating unit in which the sensor is responsive to both a rise and fall in temperature and in which the sensor is strategically positioned to detect both when the desired temperature is reached and when a cooking utensil is removed from the cooking surface; the provision of such an improved heating unit usable in conjunction with a control device which is responsive to the sensor output to determine whether more heat, less heat, or no heat is required; the provision of such an improved heating unit in which the sensor is realizable in a variety of different shapes; the provision of such an improved heating unit which is compatible with existing stoves; and, the provision of such an improved heating unit which is relatively low cost and easy to manufacture.

In accordance with the invention, generally stated, an electrical heating apparatus is used in an electric stove having a glass/ceramic cooking surface. A pan is mounted adjacent an underside of the cooking surface.

An electrical heating element installed in the pan heats a defined area of the cooking surface when electrical current is applied to the element. A sensor installed in direct contact with the cooking surface senses the temperature of the cooking area. A control unit, to which an output of the sensor is supplied, is responsive to the output to control current flow to the heating element. This allows the apparatus to respond to temperature changes at the cooking area to insure food is properly cooked. Other objects and features will be in part apparent and in part pointed out hereinafter.

BRIEF DESCRIPTION OF THE DRAWINGS

FIG. 5A illustrates a P.T.C. sensor wire used in the cooking unit, and FIG. 5B and 5C are a plan view, and partial plan view respectively, of strips used to attach the sensor wire to the underside of the cooking surface;

FIG. 6 is a graph of temperature and resistance for the sensor;

Corresponding reference characters indicate corresponding parts throughout the drawings.

DESCRIPTION OF PREFERRED EMBODIMENTS

Figure 9:
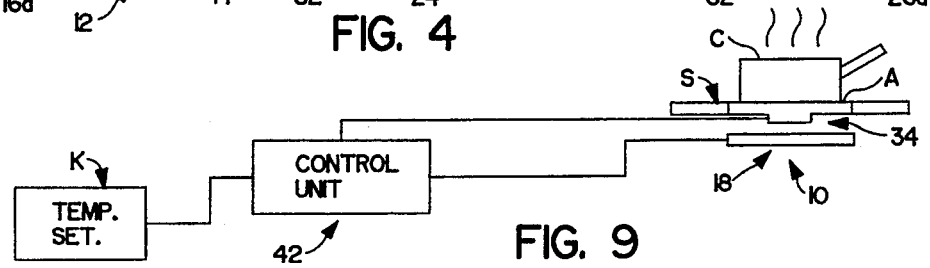

Referring to the drawings, an electric stove R has a cooking top RT which is of a glass/ceramic construction. The cooking top includes a glass/ceramic type cooking surface S having a plurality of defined cooking areas A1–A4, some of which may be of the same size (A1, A2), and others which may be larger or smaller (A3, A4). This allows different size cooking utensils C such as pots (see FIG. 9), pans, and cooking dishes to be heated on the stove. A control P located on the stove has a control knob K1–K4 for each of the cooking areas. By adjusting a knob through a range of positions, the temperature of the respective cooking areas can be adjusted.

Figure 2B:
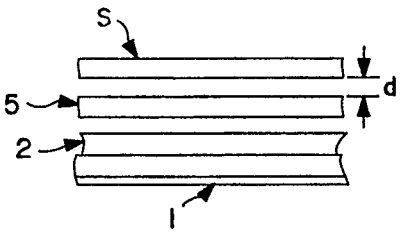
FIG. 2B PRIOR ART
FIG. 2B is a partial elevational view of the unit.
Figure 1:
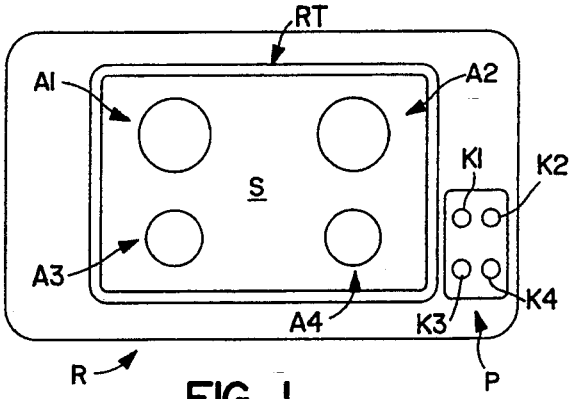
FIG. 1 is a top plan view of a cooking top for a stove.
Figure 2A:
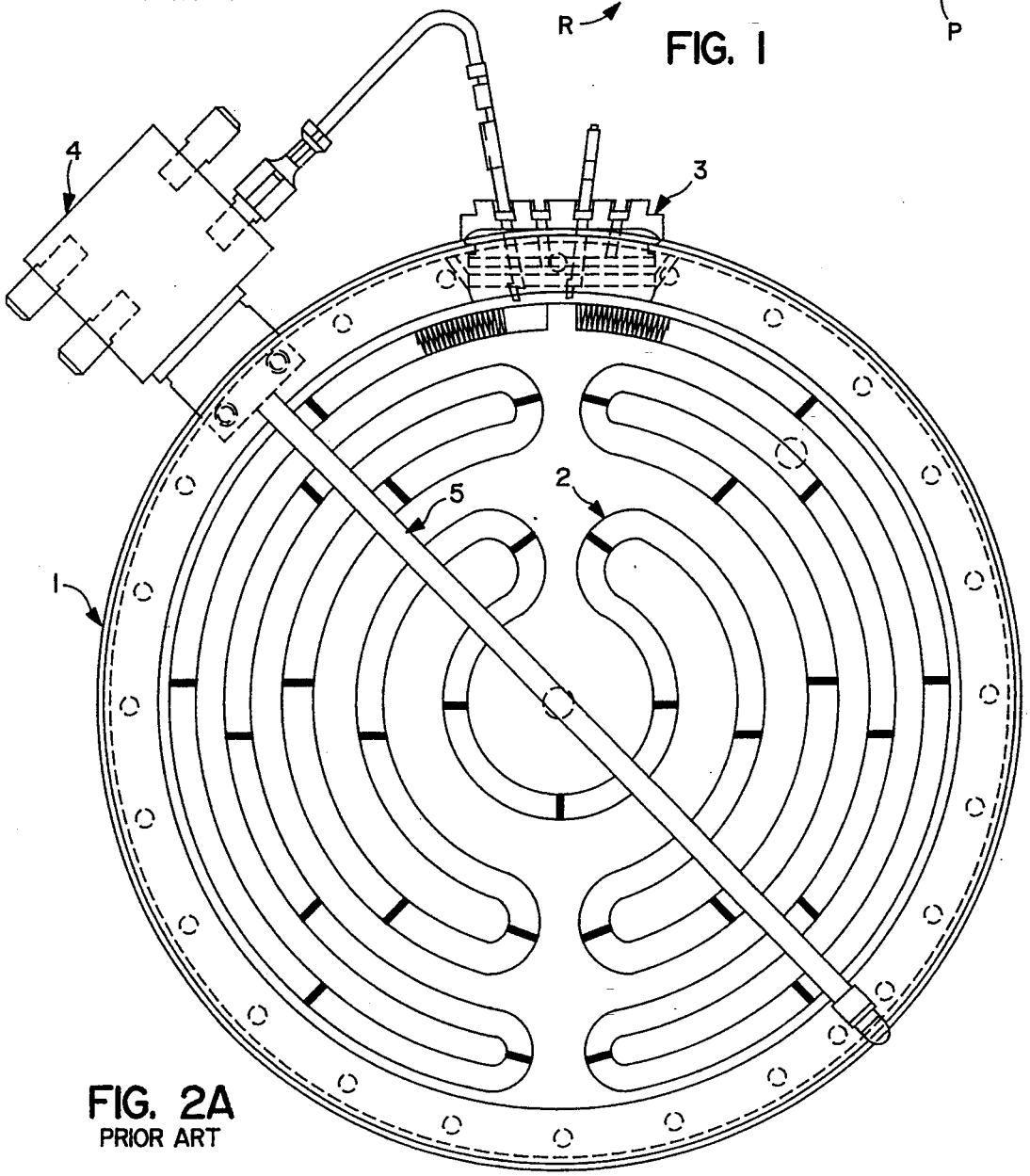
FIG. 2A PRIOR ART
FIG. 2A is a plan view of a prior art heating unit used in the cooking top.

A typical prior art heating unit U installed in a range top RT is shown in FIGS. 2A and 2B. Unit U includes a shallow metal support pan 1 which is located on the underside of the cooking surface. A heating element 2 has a sinuous shape. The respective ends of the element are attached to a terminal block 3 for electrical connection to a power source. The flow of electricity to the heating element is through one of the control knobs K and through an over-temperature power cutoff device or limiter 4. A temperature sensing rod 5 has one end connected to a switch element installed in the limiter. The rod extends diametrically across pan 1 above the heating element. The distal end of the rod is captured in the opposite side of the pan. As shown in FIG. 2B, rod 5 is positioned a distance d below the cooking surface. This distance, for example, is 0.20" (5.08 mm.). In operation, the rod senses the temperature at this point beneath the cooking surface. If the sensed ambient temperature is above the selected temperature, limiter 4 cuts off current flow to heating element 2. This prior art configuration provides no other control capability to help improve cooking.

Figure 3:
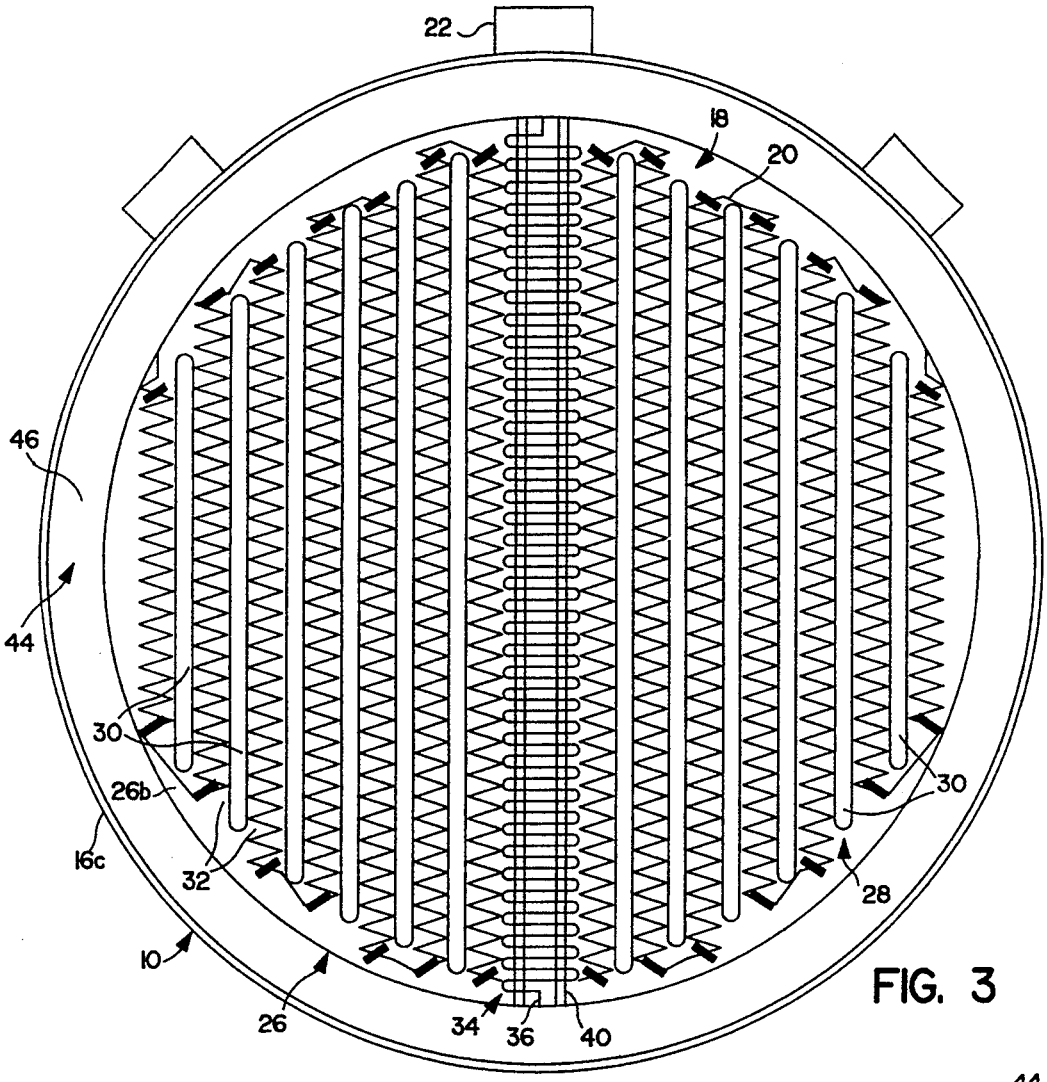
FIG. 3 is a plan view of a heating unit of the present invention for use with the cooking top.
Figure 4:
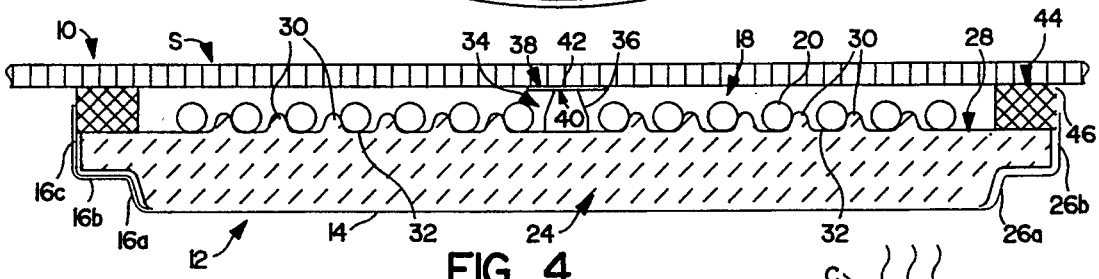
FIG. 4 is a sectional view of the heating unit taken along line 4—4 in FIG. 3.

Referring now to FIGS. 3 and 4, an electrical heating apparatus 10 of the present invention is for use in an electric stove R having a glass/ceramic cooking surface S in place of unit U. As is described hereinafter, use of apparatus 10 provides an enhanced control of a cooking operation to improve the results of heating done on a stove using the apparatus. Apparatus 10 first includes a pan 12 mounted adjacent the underside of cooking surface S. The pan having a circular base 14, and a circumferential sidewall 16 extending around the base. As seen in FIG. 4, the sidewall has a first and smaller diameter portion 16*a* which curves upwardly from base 14. Approximately one-third the height of the pan, the sidewall flattens out to form a circumferential shelf 16*b*. Then, the sidewall curves upwardly again to form a second and larger diameter portion 16*c*. It will be understood that the overall diameter of the pan may vary. That is, for heating areas A1, A2, one size pan will be used; while, for heating the areas A3, A4, a second size pan is used.

Apparatus 10 next includes an electrical heating means 18 for heating a defined area A of the cooking surface. Means 18 comprises a wire-wound electrical heating element 20. The heating element has a specified wattage which is a function of the diameter of the wire. The ends of the heating element are connected to a terminal block 22. Current flow to the heating element is through the terminal block.

An electrical insulator means 24 includes an insulation pad 26 installed in the bottom of pan 12. Pad 26 has a lower section 26*a* resting on the base of the pan, and an upper section 26*b* which is of a larger diameter and which rests upon the shelf 16*b* formed by the sidewall. In FIG. 4, it is seen that pad 26 has a contoured upper surface 28 on which the heating element is supported. Surface 28 includes a series of spaced ridges 30 which extend parallel to each other across the upper surface of the pan. Lengths of heating element 20 are installed in parallel in the valleys 32 between these ridges. The ridges accordingly separate the various lengths of wire to prevent them from inadvertently contacting each other and shorting out. This might otherwise occur, for example, when a current is applied to the wire and it expands and distorts. As shown in FIG. 3, the various ridges do not extend completely across the top of the pad. Rather, there is a space left at each end of each ridge to allow the heating element to wrap around from one reach of wire to the next.

Next, the apparatus includes a sensing means 34 for sensing the temperature of cooking surface area A. Importantly, the sensing means is in direct contact with the cooking surface to provide temperature information about the cooking area. Means 34 includes both a P.T.C. sensor comprising a sensor wire 36, and means 38 for supporting the sensor wire adjacent the underside of the cooking surface. This allows the sensor wire to be in direct contact with the cooking surface. As shown in FIG. 5A, sensor wire 36 is a nickel alloy resistance wire of, for example, 31 gauge. It will be appreciated that sensor wire 36 functions as thermocouple in that it provides an accurate indication of the temperature at a point of interest. In this application, that point of interest is the cooking area.

The resistance value of the wire exhibits a significant change when a temperature rise or fall occurs. Because the change is marked; i.e., a predictable percentage of the resistance value of the wire, temperature excursions are much more accurately noted than with previous control type systems. Unlike the prior art sensor described above with respect to FIGS. 2 and 3, sensing means 34 can readily tell when a cooking utensil is put on or removed from the cooking surface, because the change in temperature due to the change in thermal mass is reflected in a significant change in sensor wire's 36 resistance. This phenomenon, for example, can signify to a temperature controller that the current flow to the heating element should be increased when a utensil is placed on the cooking surface so the increased thermal mass can be more rapidly heated to the uniform temperature designated for cooking. Similarly, when the utensil is removed, the current can be lowered because not as much current is required to keep the cooking surface at the designated temperature. Also, when the heating unit is first turned on, a relatively high level of current can be supplied to the heating element to rapidly heat the cooking surface to the desired temperature. Again when that temperature level is sensed, the current can be lowered because not as much current is required to keep the cooking surface at that temperature.

Referring to FIG. 5B, support means 38 is shown to be an elongate strip 40 of material. The length of the material substantially corresponds to the diameter of the pan. Sensor wire 36 is affixed to the upper surface 42 of the strip by an adhesive. This adhesive also bonds the strip to the underside of the cooking surface when apparatus 10 is installed. The ends of the sensor wire are bent down under strip 40, as shown in FIG. 4, so as to not inadvertently contact the heating element and create a short. To also help prevent a short, the strip is positioned above a central portion of the support pad. No length of the heating element extends beneath the strip when it so positioned.

A current control means 42 (see FIG. 9) is supplied the output of the sensor wire. Control means 42 is responsive to the output of sensing means 34; i.e. to the changes in resistance of the P.T.C. wire to control current flow to the heating element 20. The control means may include a programmable chip which evalutes the input from the sensing means to determine what adjustment, if any, is made to the level of current. For this purpose, the programming for the chip may employ fuzzy logic. The result is that apparatus 10 is responsive to temperature changes at the cooking area to insure food is properly cooked.

Finally, apparatus 10 includes a spacer or stand-off 44 for properly positioning the pan and heating element relative to the underside of the cooking surface. Spacer 44 comprises a circular strip 46 of insulation material. The outer diameter of the strip corresponds to the diameter of pan 14 so the strip fits inside the pan. The inner diameter of the strip is such that when the strip is installed in the pan, it does not interfere with the heating element or its associated wiring. The base of the strip rests upon the upper contoured surface 28 of pad 26.

Operation of apparatus 10 for the control purposes described above is shown in FIG. 6. In the test performed using the apparatus, a 7/16", or 0.4375" (1.11 cm.) wide sensor wire 36 configured as shown in FIGS.

3 and 5, was mounted on a ⅛ or 0.125" (0.32 cm.) wide strip 40. The sensor was located against the underside of cooking surface S so to be in contact with the surface. The sensor wire was also across the centerline of an electrical heating element 20; which, was an 1900w. heating element. The cooking surface S was a standard cooking surface that was approximately 5/32" (4 mm.) thick.

There are two plots in FIG. 6. One plot is for the glass temperature (in ° F.) versus time, and the other is the resistance value (in ohms) of the sensor wire versus time. As shown by the plots, the temperature of the cooking surface reaches a temperature of approximately 1150° F. (620° C.) in approximately 8 minutes after the heating element is energized. During this interval, the resistance of the sensor wire increases from approximately 1.5 ohms to approximately 4.7 ohms. Now, a pan containing one pint of water is placed on the area A of the cooking surface. The temperature of the cooking surface falls to approximately 1000° F. (538° C.). There is a corresponding fall in the sensor wire temperature to approximately 4.25 ohms. This represents a resistance change of about 9%. This is a significant change in resistance value and is readily usable by a control means 42 to effect a change in the current supplied to the heating element.

Next, the pan with the water is removed from the cooking surface. The cooking surface temperature returns almost back to its temperature level prior to placement of the pan on it. A corresponding increase in sensor wire 36 resistance also occurs.

When the pan with the water is subsequently replaced on the cooking surface, the same pattern of temperature and sensor wire resistance changes are repeated. Now, however, the pan is left on the cooking surface until the water in the pan boils away. Once the water is gone, the cooking surface temperature rapidly rises from approximately 1000° F. to approximately 1200° F. (649° C.). The sensor wire resistance increases from 4.25 ohms to approximately 4.8 ohms. This is slightly over an 11% increase and again represents a significant change in value. The condition represented by this portion of the test is analogous to an over-temperature condition for which the control means would greatly reduce, if not stop, current flow to the heating element.

It will be seen in reviewing both plots that the change in sensor wire resistance tracks the change in cooking surface temperature very closely. Also, as the thermal mass changes when the pan is placed on, or removed from, the cooking surface, or when the liquid in the pan boils away, the sensor wire resistance accurately reflects the change in cooking surface temperature. It will be further appreciated that there is no significant lag between the change in cooking surface temperature sensor wire resistance change. And, since these resistance changes or on the order of 10%, they are significant enough that a control means 42 can effectively implement a cooking control strategy based on these changes.

Figure 7:
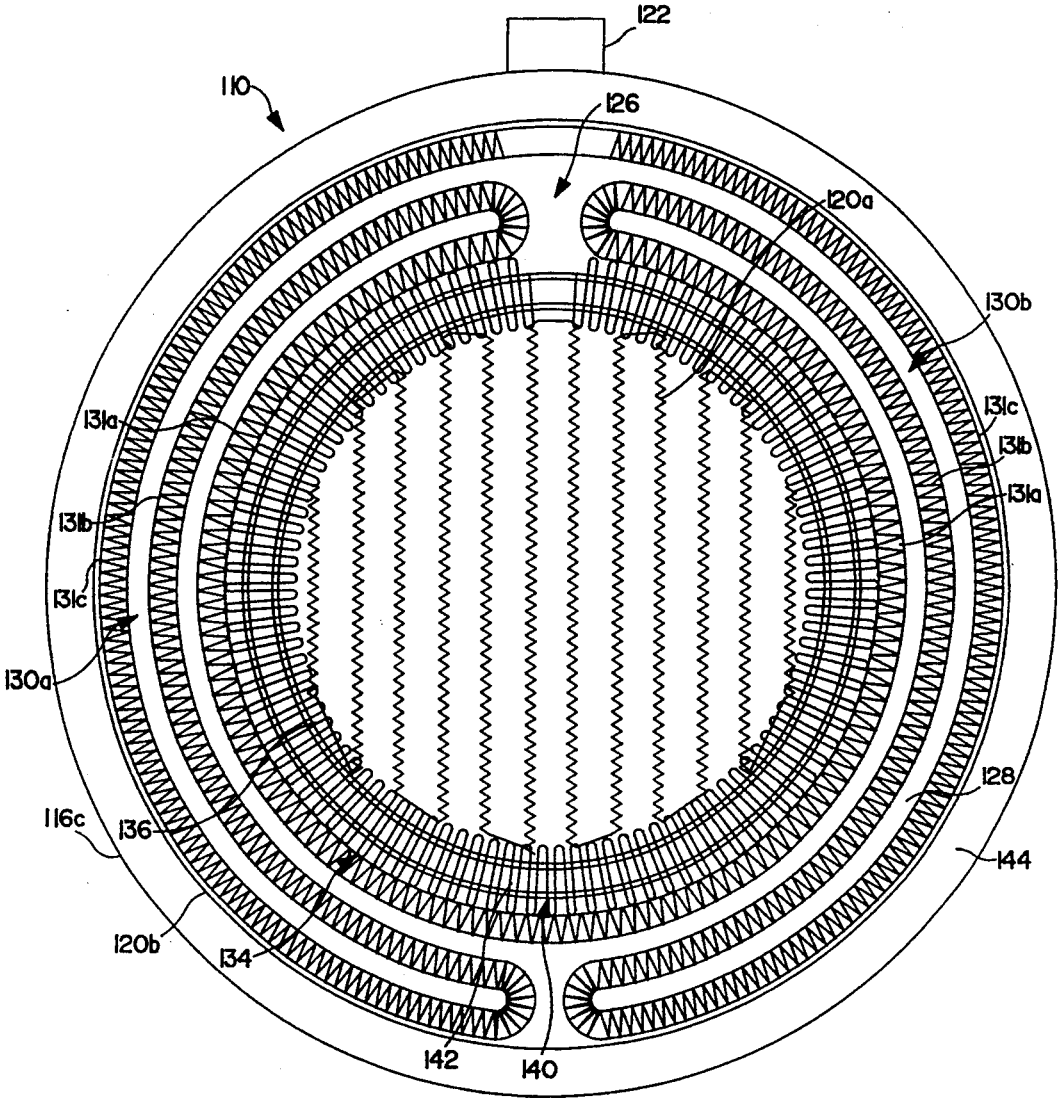
FIG. 7 is a top plan view of a second embodiment of the heating unit.
Figure 8:
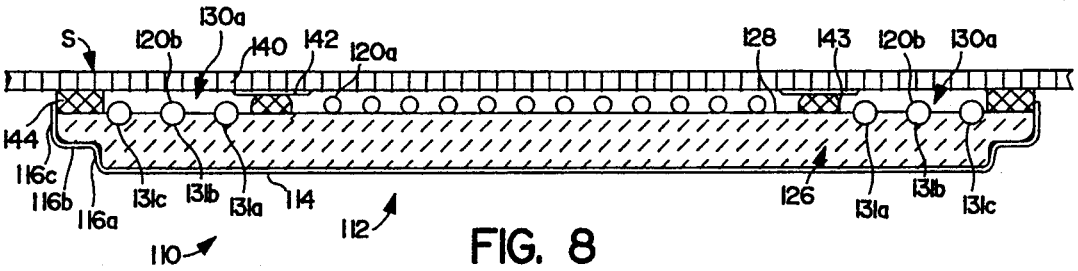
FIG. 8 is a sectional view of the unit taken along line 8—8 in FIG. 7; and, FIG. 9 is a block diagram representation of the apparatus.

Referring now to FIGS. 7 and 8, a second embodiment of the electrical heating apparatus of the present invention is indicated generally 110. A pan 112 is mounted adjacent an underside of cooking surface S. The pan has a circular base 114 and a sidewall 116. As with pan 12, the sidewall has a lower section 116*a*, a flattened portion 116*b* forming a shelf, and an upper section 116*c*.

A first electrical heating element 120*a* is installed in pan 112 to heat a defined area A of the cooking surface. Now, a second and separate electrical heating element 120*b* is also installed in the pan. This second heating element is also for heating the cooking surface when an electrical current is supplied to it. Both heating elements are wire-wound heating elements. The first and second heating element have different wattage ratings; and, preferably, the second heating element has a higher wattage rating than the first.

An insulator pad 126 is installed in pan 112 and has a contoured upper surface 128 on which both heating elements are supported. As with pad 26, pad 126 is shaped to fit in pan 112 and to rest on the shelf 116*b* formed by the pan sidewall. Unlike pad 26 of the previous embodiment, pad 126 has a flat center section to the outside of which is formed a pair of concentric channels, 130*a* and 130*b* respectively. Each channel is formed on one-half of the pad surface and is formed in a serpentine pattern. Each channel has an inner trough 131*a*, which is formed approximately one-half the distance from the center of the pad to the sidewall of the pan; a middle trough 131*b*; and, an outer trough 131*c*. The respective inner troughs are joined together at one end.

First heating element 120*a* is positioned on the flat center portion of pad surface 128. The heating element has a series of parallel extending reaches. The length of the respective reaches of the heating element increases from the outer to the inner reaches. Second heating element 120*b* is positioned in the troughs forming the respective channels. Because the inner troughs of each channel are joined, the heating element forms a single unit substantially surrounding heating element 120*a*. The ends of both heating elements are connected to an electrical terminal block 122 so current can be applied to the heating elements.

A P.T.C. sensor 134 comprising a sensor wire 136 and a support strip 140 for positioning the sensor wire adjacent the underside of the cooking surface is also provided. As before, the sensor wire is of a generally sinusoidal shape. However, the sensor wire is now formed into a circular shape and mounted on an upper surface 142 of the support strip which is also now circular in shape. When mounted in place, the strip holds the sensor wire in direct contact with the cooking surface. Also, the sensor wire and strip, when mounted in place, are positioned between the first and second electrical heating elements. As shown in FIG. 7, the outer diameter of the annular ring formed by the sensor wire corresponds to inner diameter of trough 131*a* of the channels. The inner diameter of the ring corresponds to the outer diameter of a ring formed by the various parallel lengths of wire of heating element 120*a*. In addition, sensor 134 also includes a circular spacer 143 whose base rests upon the flat surface portion of pad 126. The height of this spacer is the same as that of a circular spacer 144 which is installed adjacent the outer rim of pad 126 to space the heating elements from the cooking surface.

The heating unit 110 is usable with current control means 42. As with unit 10, the output of sensor 134 is supplied to the control means to provide an indication of surface temperature. In turn, the control means controls current flow to the heating elements to control the cooking surface temperature. Apparatus 110 differs in operation from that of apparatus 10 because of the presence of the second and separate heating element. Now, the cooking strategy implemented with the control means may permit both heating elements to be simultaneouly energized, one energized and the other not, or both energized but with different levels of current flow to each. Because heating element **120*b* is a higher wattage than element 120*a*, element 120*b* may be energized to rapidly heat the cooking surface to a desired temperature. Therafter, heating element 120*a* is energized to maintain the temperature at that level. Since element 120*a* is of a lower wattage, it requires less energy to do this than using element 120*b*. When, a cooking utensil is placed on, or removed from, the cooking surface, so the surface temperature fluctuates as shown in the graph of FIG. 6**, the current level to one or both elements may be varied in accordance with the cooking strategy employed. Further, if a heating element fails during a cooking operation, the control means would have the capability of controlling the operation using only the operative element.

What has been described is an improved heating unit for use in stoves and the like. The heating unit heats the surface of a glass/ceramic cooking top to a desired temperature and includes a positive temperature coefficient (P.T.C.) sensing element to indicate when the desired temperature is reached. The sensor is responsive to both rises and falls in cooking surface temperature, and the sensor is strategically positioned to detect both when a cooking utensil placed on, or removed from, the cooking surface. When used in conjunction with a suitable control device, an automatic determination can be made as to whether more heat, less heat, or no heat is required to properly cook. The sensor is available in different configurations, and the heating unit is compatible with both new and existing stoves.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. Electrical heating apparatus for use in an electric stove having a glass/ceramic cooking surface comprising:

a pan mounted adjacent an underside of the cooking surface;

a first electrical heating element installed in the pan for heating a defined area of the cooking surface when an electrical current is applied to the heating element;

a second and separate electrical heating element installed in the pan for also heating the cooking surface when an electrical current is applied thereto, said second electrical heating element having a different wattage than said first heating element;

an insulator installed in the pan and having a contoured upper surface on which both heating elements are supported, the insulator having a generally flat central section, and concentric channels formed radially outwardly of said central section, said first heating element being installed on said central section of the insulator and said second heating element being installed in the channels such that said heating elements are concentric with each other;

a temperature sensor element comprising a sensor wire supported adjacent the underside of the cooking surface such that the sensor directly contacts the cooking surface, said sensor element being a circular wire sensor positioned between said first and second heating elements so as to be concentric therewith; and, means for supporting said sensor element adjacent the underside of the cooking surface.

2. The apparatus of claim 1 further including current control means to which an output of the temperature sensor is supplied, the control means being responsive to the sensing means output to control current flow to both the first and second heating elements whereby the apparatus is responsive to temperature changes at the cooking surface to insure food is properly cooked.

3. The electrical heating apparatus of claim 2 wherein both the first and second heating elements are wire-wound heating elements.

4. The electrical heating apparatus of claim 3 wherein the support means includes a circular strip on which the sensor wire is fixed, the strip holding the sensor wire in place against the underside of the cooking surface.

5. The electrical heating apparatus of claim 4 wherein said second heating element is a higher wattage element than said first heating element.

6. The electrical heating apparatus of claim 5 wherein said sensor is of a nickel alloy P.T.C. material.

* * * * *